US009428298B2

(12) United States Patent
Bersamin et al.

(10) Patent No.: US 9,428,298 B2
(45) Date of Patent: Aug. 30, 2016

(54) DIVIDERLESS PALLETIZED PACKAGING SYSTEM WITH INTERLOCKING TRAY AND CORNER POSTS

(71) Applicants: Sonoco Development, Inc., Hartsville, SC (US); Frito-Lay North America, Inc., Plano, TX (US)

(72) Inventors: Glen Bersamin, New Lenox, IL (US); Valentine Tomaszewski, Western Springs, IL (US); John G. Olmsted, Jr., McKinney, TX (US); Daniel Lee Mathews, McKinney, TX (US); Sunitha Ann Nair, Dallas, TX (US)

(73) Assignees: Sonoco Development, Inc., Hartsville, SC (US); Frito-Lay North America, Inc., Plano, TX (US)

( * ) Notice: Subject to any disclaimer, the term of this patent is extended or adjusted under 35 U.S.C. 154(b) by 301 days.

(21) Appl. No.: 14/072,160

(22) Filed: Nov. 5, 2013

(65) Prior Publication Data

US 2015/0122690 A1 May 7, 2015

(51) Int. Cl.

| | |
|---|---|
| ***A47F 5/11*** | (2006.01) |
| ***B65D 5/20*** | (2006.01) |
| ***B65D 5/44*** | (2006.01) |
| ***B65D 5/00*** | (2006.01) |

(52) U.S. Cl.

CPC ..... *B65D 5/006* (2013.01); *A47F 5/114* (2013.01); *A47F 5/116* (2013.01); *B65D 5/445* (2013.01)

(58) Field of Classification Search

CPC .... B65D 5/5033; B65D 5/006; B65D 5/445; B65D 5/4266; B65D 19/385; A47F 5/11; A47F 5/112; A47F 5/114; A47F 5/116

USPC ..... 211/135, 188, 153, 194, 126.2, 126.16

See application file for complete search history.

(56) References Cited

U.S. PATENT DOCUMENTS

| | | | | | |
|---|---|---|---|---|---|
| 944,381 | A * | 12/1909 | Robillard | B65D 5/006 | 217/69 |
| 2,825,519 | A * | 3/1958 | Potts | A47F 5/114 | 229/117.01 |
| 3,164,350 | A * | 1/1965 | Taub | A47F 5/114 | 206/764 |
| 3,372,813 | A * | 3/1968 | Ishida | A47F 5/116 | 211/135 |
| 3,596,771 | A * | 8/1971 | Wuensch | A47F 5/112 | 211/135 |
| 3,768,637 | A * | 10/1973 | Whang | A47F 5/10 | 206/736 |
| 4,706,824 | A * | 11/1987 | Mercer | A47F 5/118 | 108/186 |
| 5,657,872 | A | 8/1997 | Leftwich et al. | | |
| 7,066,342 | B2 * | 6/2006 | Baechle | B65D 5/006 | 206/600 |
| 7,118,023 | B2 | 10/2006 | Holdsworth | | |
| 7,137,517 | B2 * | 11/2006 | Lowry | B65D 21/0215 | 206/586 |

(Continued)

FOREIGN PATENT DOCUMENTS

WO WO 2011/154881 * 12/2011 ..... A47F 5/11

*Primary Examiner* — Michael Safavi

(74) *Attorney, Agent, or Firm* — Miller, Matthias & Hull LLP

(57) ABSTRACT

A modular packaging system for shipping and displaying palletized products is provided. The packaging system comprises a plurality of vertically stacked trays for holding the products and corner posts extending between vertically adjacent trays for spacing and supporting the trays. The corner posts and trays are locked together in a number of ways to strengthen and stabilize the system. The system is strong enough not only to support the weight of the products on the trays and withstand the vibration and impact forces that can occur during shipping, but to withstand the weight of one or more units stacked on top.

13 Claims, 8 Drawing Sheets

(56) References Cited

U.S. PATENT DOCUMENTS

| | | | | |
|---|---|---|---|---|
| 7,632,372 | B2 | 12/2009 | Hoffmann et al. | |
| 8,833,573 | B2 * | 9/2014 | Tomaszewski | B65D 19/385 108/186 |
| 2002/0175133 | A1 * | 11/2002 | Hiltke | A47F 5/116 211/132.1 |
| 2006/0151410 | A1 * | 7/2006 | Lowry | A47F 3/142 211/126.16 |
| 2008/0295374 | A1 * | 12/2008 | Bergland | A47F 5/112 40/607.1 |
| 2013/0075302 | A1 * | 3/2013 | Bucknell | A47F 5/114 206/765 |
| 2013/0180941 | A1 * | 7/2013 | Tomaszewski | B65D 19/385 211/126.12 |

* cited by examiner

DIVIDERLESS PALLETIZED PACKAGING SYSTEM WITH INTERLOCKING TRAY AND CORNER POSTS

BACKGROUND

1. Field of the Invention

This patent relates to a tray and post type packaging system for shipping and displaying palletized products. More particularly, this patent relates to a dividerless tray and post type packaging system in which the construction of the trays and corner posts provides extra strength and stability.

2. Description of the Related Art

Palletized packaging systems suitable for both shipping products and displaying them at retail are well known. For example, Sonoco Products Company of Hartsville, S.C. makes a tray and post type packaging system that is described in co-owned U.S. Pat. No. 7,066,342, incorporated herein by reference. The products in their primary packages (what the consumer actually buys) are arranged on the trays. The entire unit is self-supporting and may be displayed in the store aisle.

There are two general types of palletized packaging systems: those in which the trays are supported by the products themselves, and those in which the trays are supported wholly or partly by structural components, such as corner posts, partitions and dividers. The use of partitions or dividers between each tray can improve stacking strength, but can make it difficult for consumers to view the products.

The objective of the present invention is to provide a tray and post type packaging system for the shipping and display of products that has increased strength and stability without the use of partitions or dividers.

Another objective of the present invention is to provide a tray and post type packaging system that eliminates the need for outer shroud panels.

SUMMARY OF THE INVENTION

The present invention is a tray-and-post type packaging system for shipping and displaying products. The packaging system includes an interlocking tray-and-post construction that provides extra strength and stability and eliminates the need for outer shroud panels. The trays and posts may be shipped flat to minimize shipping space and assembled on-site. The system is strong enough to be used without dividers supporting the trays, which can obscure the products displayed thereon.

In one aspect of the invention a unitary folded blank for making a corner post is provided. The folded blank comprises two halves foldably connected to each other. An outer half comprises two substantially L-shaped outer panels foldably connected along an outer edge fold line. Each L-shaped outer panel comprises an outer leg member adjacent the outer edge fold line and an outer foot member extending outwardly from the outer leg member away from the outer edge fold line and terminating at a free distal edge. An outer reinforcing panel having an outer angled free edge extends between the outer leg member and the outer foot member. The outer leg member, outer foot member and outer reinforcing panel form one contiguous, unitary structure lacking any fold or score lines.

The inner half comprises two substantially L-shaped inner panels foldably connected along an inner edge fold line. The inner edge fold line is co-linear with the outer edge fold line. Each L-shaped inner panel comprises an inner side panel adjacent the inner edge fold line, a narrow leg member hingedly attached to the inner side panel along a vertical fold line and an inner foot member extending outwardly from the narrow leg member and terminating at a free distal edge. An inner reinforcing panel having an inner angled free edge extends between the narrow leg member and the inner foot member. The narrow leg member, inner reinforcing panel and inner foot member form one contiguous substantially L-shaped structure lacking any fold or score lines.

The inner half may further comprise a flap cut out of each inner foot member and hingedly attached to the outer foot member along the bottom fold line. The inner half may further comprise locator tabs extending from a top edge and cut outs adjacent the bottom fold line and vertically aligned with locator tabs. The locator tabs and cut outs may straddle the vertical fold line.

In another aspect of the invention a corner post made from a folded blank is provided. The folded blank has an outer half and an inner half connected by a bottom fold line. The corner post comprises a four-sided, substantially rectilinear tubular portion and foot members extending laterally outward from the tubular portion. The tubular portion comprises two inner side panels formed from the inner half of the blank and hingedly connected along an inner edge fold line and two outer leg members formed from the outer half of the blank and hingedly connected along an outer edge fold line. A reinforcing panel having an angled free edge may extend between the leg member and the foot member on either side of the tubular portion. The corner post may further comprise flaps cut out of each inner half and hingedly attached to a foot member along the bottom fold line. The corner post may also comprise a top edge opposite and parallel to the bottom fold line, locator tabs extending from the top edge, and cut outs adjacent the bottom fold line, wherein the cut outs 88 are vertically aligned with locator tabs.

In still another aspect of the invention a packaging system for shipping and displaying products is provided. The packaging system comprises one or more levels, each level comprising a tray and corner posts. The tray is made from a first folded blank and has a bottom panel for supporting the products and having a perimeter, and two opposing side walls and two opposing end walls extending upward from the perimeter.

The corner post is made from a second folded blank. The second folded blank has an outer half and an inner half foldably connected along a bottom fold line. The corner post comprises a four-sided, substantially rectilinear tubular portion comprising two inner side panels formed from the inner half and hingedly connected along an inner edge fold line and two leg members formed from the outer half and hingedly connected along an outer edge fold line. A foot member extends laterally outward from each leg member and forms a corner with its respective leg member. A reinforcing panel may be disposed at the corner. The reinforcing panel may have an angled free edge extending between the leg member and the foot member. One foot member is at least partially encapsulated within a side wall and the other foot member is at least partially encapsulated within an end wall.

Each side wall may comprise an outer panel foldably connected to the bottom panel along a side fold line co-linear with the perimeter, an inner panel foldably connected to the outer panel along double fold lines parallel to the side fold line, a lip foldably connected to the inner panel along a lip fold line parallel to the side fold line, and an angled panel foldably connected to the outer panel along angled double fold lines. The angled double fold lines form a non-right angle with the double fold lines. Each angled panel at least partially encapsulates a reinforcing panel of a corner post.

At least one of the inner side panels may define a vertical slot, and the angled panel may have a tab that extends into the vertical slot.

The inner half of each corner post blank may further comprise a flap hingedly attached to the foot member along the bottom fold line, the flap defining a flap slot adjacent the bottom fold line so that a tab extending downward from the inner panel may be inserted into the flap slot. The side wall lip may abut an edge of the flap.

The system is strong enough not only to support the weight of the products on the trays and withstand the vibration and impact forces that can occur during shipping, but to withstand the weight of one or more units stacked on top. The system is particularly suited for shipping and displaying irregularly shaped items and items that cannot withstand vertical stacking forces, such as soft-packaged goods, since the system can bear the entire stacking load.

THE DRAWINGS

DETAILED DESCRIPTION OF THE INVENTION

Figure 1:
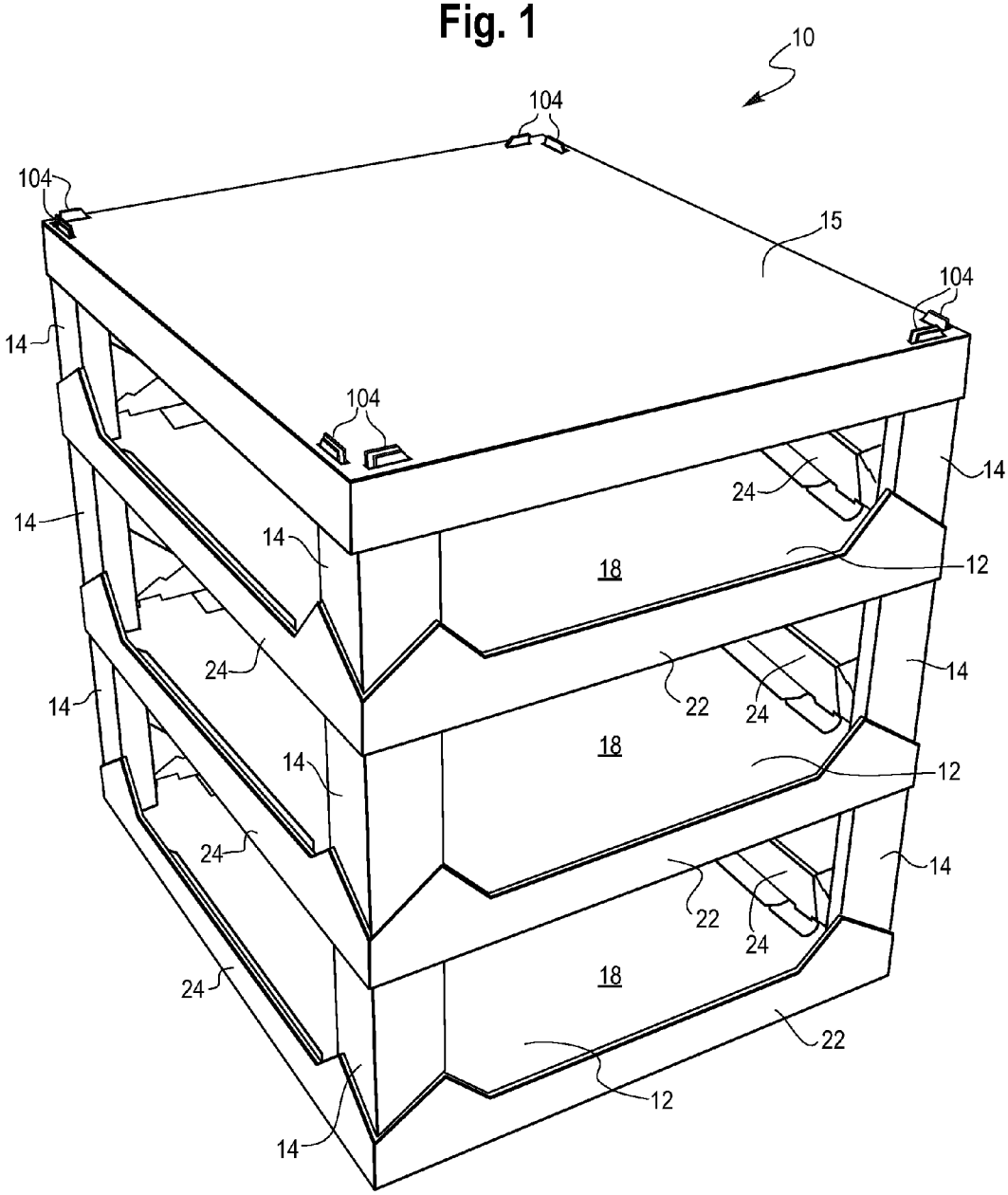
FIG. 1 is a perspective view of one embodiment of a tray-and-post type packaging system according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The invention is a tray-and-post type packaging system for shipping and displaying products. The packaging system includes an interlocking tray-and-post construction that provides extra strength and stability and eliminates the need for outer shroud panels. The trays and posts may be shipped flat to minimize shipping space and assembled on-site. The system is strong enough to be used without dividers supporting the trays, which can obscure the products displayed thereon.

The Packaging System

Turning to the drawings, there is shown in FIG. 1 one embodiment of the present invention, a packaging system 10 for shipping and displaying products. The packaging system 10 comprises a plurality of trays 12 for holding products in their primary packaging, corner posts 14 that separate and support the trays 12 and a top cap 15. The corner posts 14 space the trays 12 apart and provide a platform on which each tray 12 can rest. The height of the corner posts 14 is determined by the height of the products in their primary packaging or, more particularly, the desired height between trays 12. The packaging system 10 may be wrapped in an outer wrap (not shown) to protect the products from dust and damage during shipment, and carried on a standard pallet (not shown).

Figure 2:
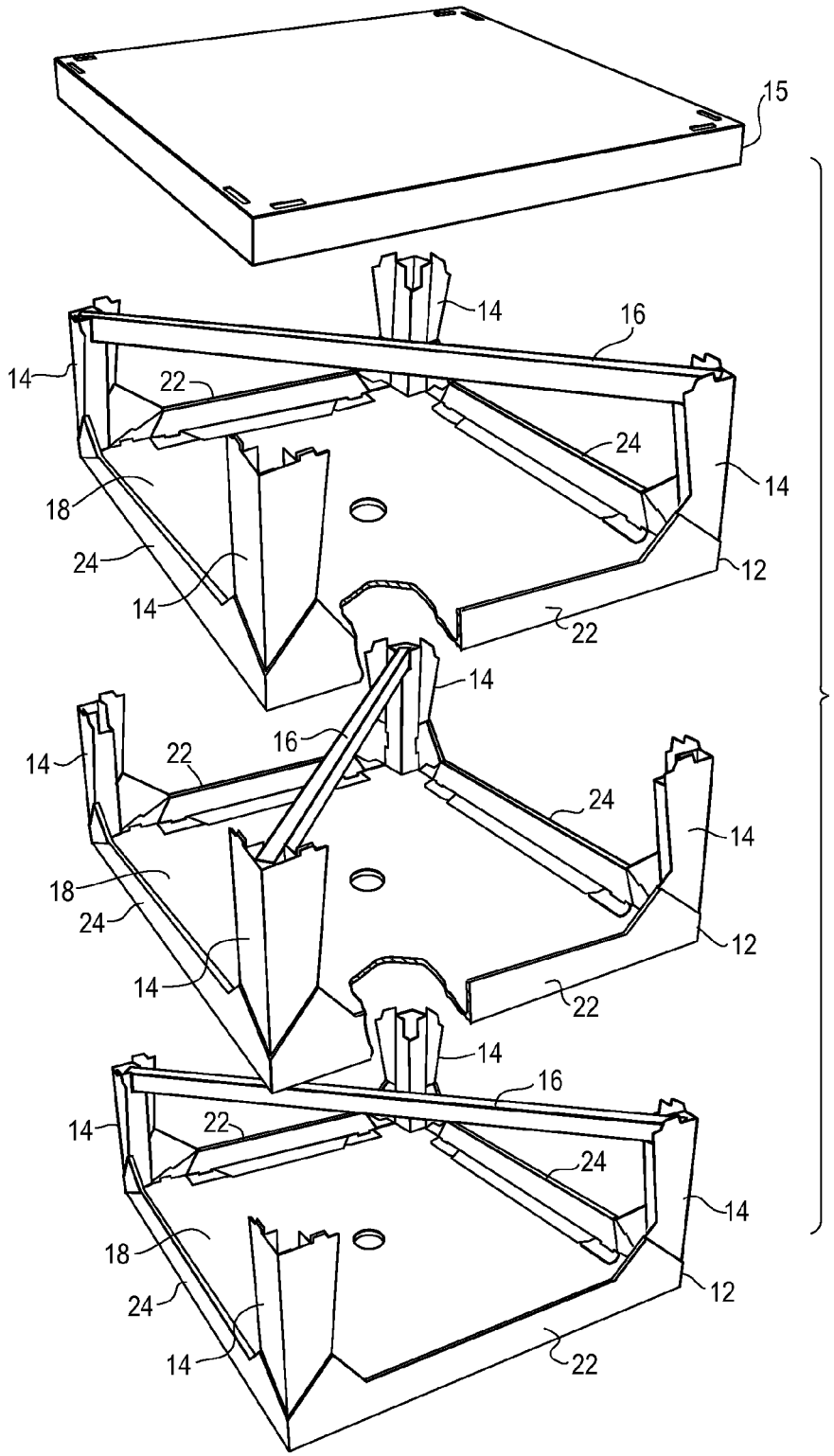
FIG. 2 is an exploded perspective view of the packaging system of FIG. 1.

FIG. 2 is an exploded perspective view of the packaging system 10 of FIG. 1. Brace members 16 may be added to the packaging system 10 to add further support to the trays 12. Each tray 12 comprises a bottom panel 18 for supporting the products and two opposing side walls 22 and two opposing end walls 24 extending upwardly from the bottom panel 18. The side walls 22 and the end walls 24 capture portions of the corner posts 14 to help lock the packaging system 10 together as described in detail below.

Tray Blank

Figure 3:
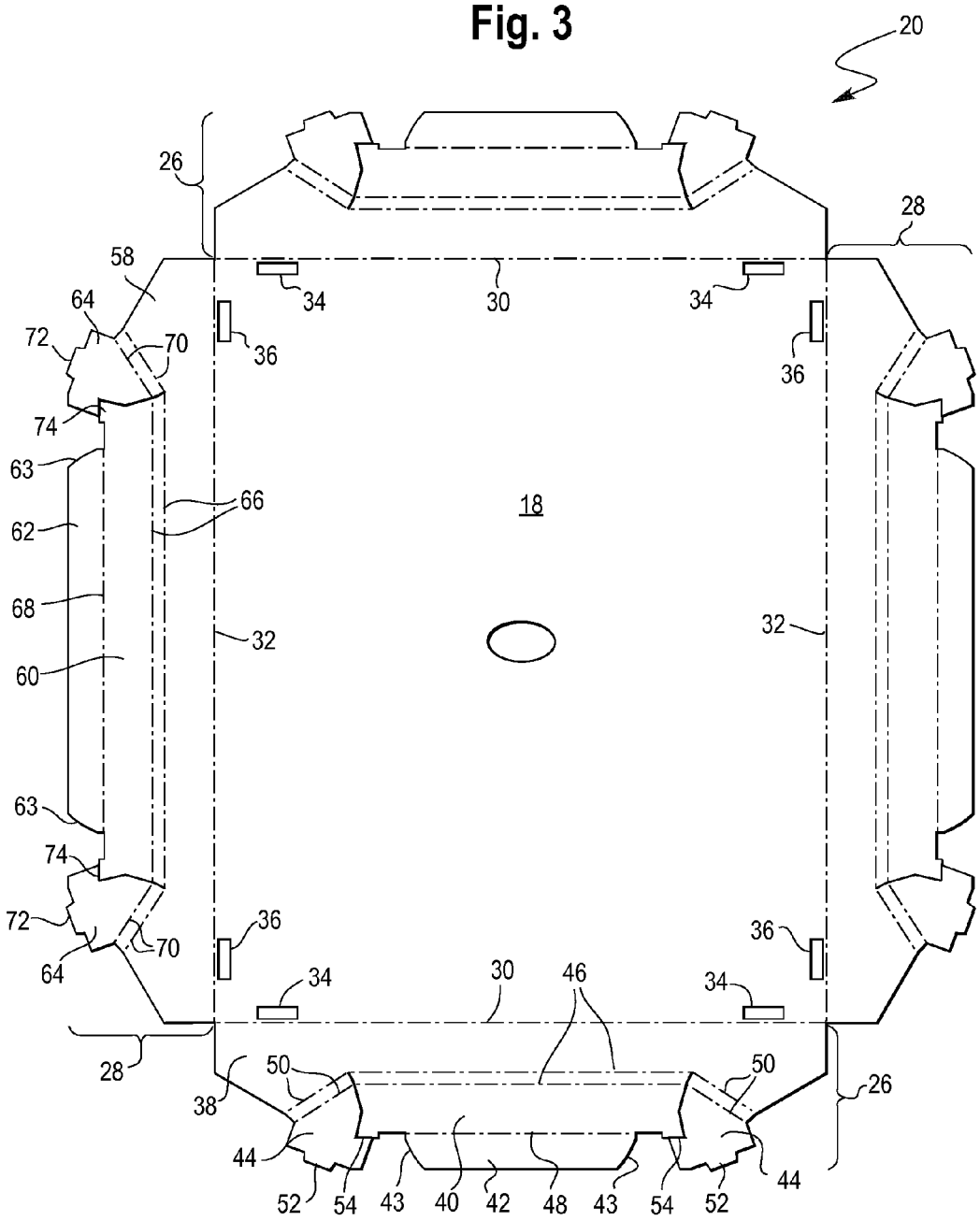
FIG. 3 is a top plan view of a blank used to form a tray of the packaging system of FIG. 1.

FIG. 3 is a top plan view of a blank 20 used to form a tray 12 of the packaging system 10 of FIG. 1. The blank 20 may be made from any suitable material, but corrugated board is preferred for its combination of strength, light weight and recyclability. The blank 20 is shown cut and scored from a single piece of material to the desired shape, and comprises a rectangular bottom panel 18, two opposing side wall assemblies 26 and two opposing end wall assemblies 28. The perimeter of the rectangular bottom panel 18 is defined by parallel, opposing side fold lines 30 and parallel, opposing end fold lines 32. A slot 34 is disposed in the bottom panel 18 adjacent each side fold line 30 near each corner. Likewise, a slot 36 is disposed in the bottom panel 18 adjacent each end fold line 32 near each corner.

Each side wall assembly 26 extends outward from a side fold line 30 and comprises an outer panel 38, an inner panel 40, a lip 42 and two angled panels 44. The outer panel 38 is foldably connected to the tray bottom panel 18 along the side fold line 30. The inner panel 40 is foldably connected to the outer panel 38 along double fold lines 46. The lip 42 is foldably connected to the inner panel 40 along a lip fold line 48. The angled panels 44 are foldably connected to the outer panel 38 along angled double fold lines 50. With the exception of the angled fold lines 50, the fold lines 30, 46, 48 are all parallel to each other. Each angled panel 44 has a tab 52 extending outwardly from the rest of the angled panel 44 and configured to fit into a vertical slot 122 in one of the corner posts 14. Each inner panel 40 has a pair of tabs 54 extending outwardly (away from the bottom panel 18) and configured to fit into a flap slot 120. The outer panel 38 is substantially contiguous with the bottom panel 18 along the entire length of the side fold line 30. The inner panel 40 is shorter, being contiguous with the outer panel 38 along the entire length of the double fold lines 46. The angled double fold lines 50 extend outwardly at an angle from either end of the double fold lines 46.

Likewise, the two opposing end wall assemblies 28 extend outward from the end fold lines 32. Each end wall assembly 28 comprises an outer panel 58, an inner panel 60, a lip 62 and two angled panels 64. The outer panel 58 is foldably connected to the tray bottom panel 18 along the side fold line 32. The inner panel 60 is foldably connected to the outer panel 58 along double fold lines 66. The lip 62 is foldably connected to the inner panel 60 along a fold line 68. The angled panels 64 are foldably connected to the outer panel 58 along angled double fold lines 70. The angled double fold lines 70 form a non-right angle with the double fold lines 66 and with the end fold line 32. Each angled panel 64 has a tab 72 that fits into a vertical slot 122 in one of the corner posts 14. Each inner panel 60 has a pair of tabs 74 extending outwardly (away from the bottom panel 18) and configured to fit into a flap slot 120. The outer panel 58 is substantially contiguous with the bottom panel 18 along the entire length of the end fold line 32. The inner panel 60 is shorter, being contiguous with the outer panel 58 along the entire length of the double fold lines 66. The angled double fold lines 70 extend outwardly at an angle from either end of the double fold lines 66.

Corner Post Blank

Figure 4:
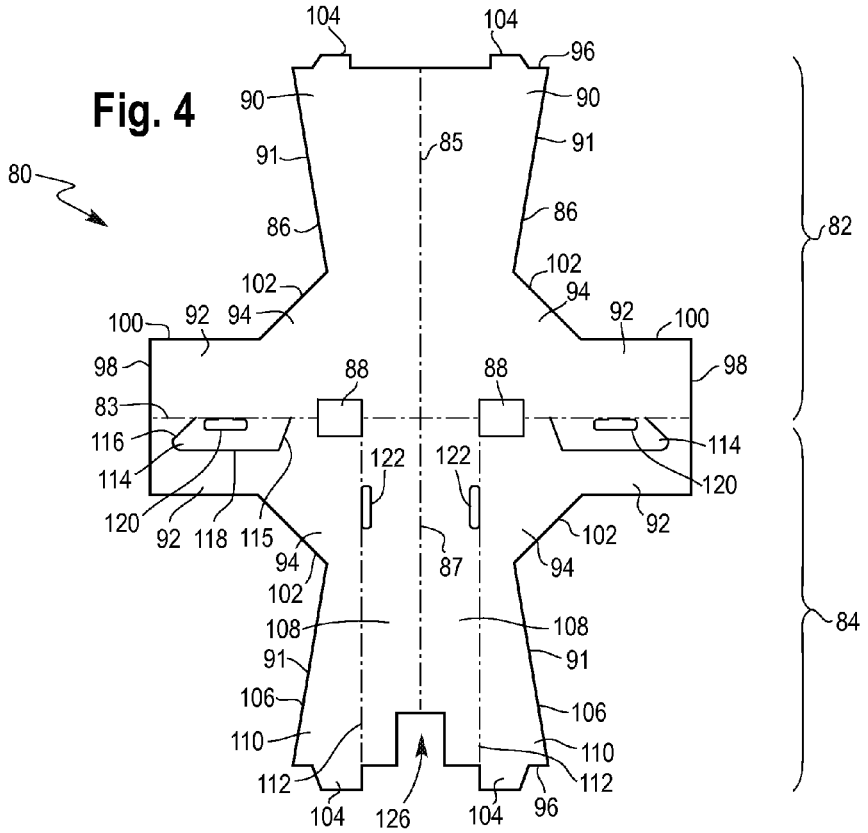
FIG. 4 is a top plan view of a blank used to form a corner post of the packaging system of FIG. 1.

FIG. 4 is a top plan view of a blank 80 used to form a corner post 14 of the packaging system 10 of FIG. 1. The blank 80 may be made from any suitable material, but corrugated board is preferred for its combination of strength, light weight and recyclability. The blank 80 is shown cut and scored from a single piece of material to the desired shape. The blank 80 comprises an outer half 82 and an inner half 84 foldably connected along a bottom fold line 83. The outer half 83 is bisected by an outer edge fold line 85 and the inner half is bisected by an inner edge fold line 87 co-linear with the outer edge fold line 85. Together, the outer edge fold line 85 and the inner edge fold line 87 form a single vertical fold line that is perpendicular to the bottom fold line 83.

The outer half 82 is so-called because it forms the outer portion of the corner post 14, i.e., the two orthogonal sides of the corner post 14 that face away from the products. The outer half 82 comprises two substantially L-shaped outer panels 86 foldably connected along the outer edge fold line 85. Each L-shaped outer panel 86 may be a mirror image of the other, and comprises a leg member 90, a foot member 92 and a reinforcing panel 94. The leg member 90, foot member 92 and reinforcing panel 94 will now be described separately, although they form one unitary, contiguous, substantially L-shaped outer panel 86 lacking any fold or score lines.

The two leg members 90 are foldably connected to each other along the outer edge fold line 85. Each leg member 90 extends vertically from the bottom fold line 83 to a top edge 96 and outwardly—away from the outer edge fold line 85—to a free edge 91. Preferably the free edge 91 forms a non-right angle with the outer edge fold line 85 so that the leg member 90 is wider near the top edge 96. Locator tabs 104 extend upward from the top edge 96.

Each foot member 92 extends outwardly from a leg member 90 and terminates at a free distal edge 98 located opposite (away from) the outer edge fold line 85. Each foot member 92 extends vertically from the bottom fold line 83 to a top edge 100.

Each reinforcing panel 94 is substantially triangular and may be thought of as being located at the inner corner where the leg member 90 and the foot member 92 meet. Each reinforcing panel 94 has an angled free edge 102 that extends between the leg member free edge 91 and the foot member top edge 100. The angled free edge 102 of the reinforcing panel 94 defines a non-right angle with the top edge 100 of the foot member 92. The reinforcing panels 94 create a stiffer corner post 14 and thus a stronger packaging system 10.

The inner half 84 is so-called because it forms the inner part of the corner post 14, i.e., the part of the corner post 14 that face toward the products. In similar fashion to the outer half 82, the inner half 84 comprises first and second substantially L-shaped inner panels 106 foldably connected along inner edge fold line 87. Each L-shaped inner panel 106 may be a mirror image of the other, and comprises, from the inner edge fold line 87 outward: an inner side panel 108, a (narrow) leg member 110, a reinforcing panel 94 and a foot member 92. As with the outer half 82, the leg member 110, reinforcing panel 94 and foot member 92 form one contiguous L-shaped structure lacking any fold or score lines.

The inner side panel 108 is separated from the rest of the L-shaped inner panel 106 by a fold line 118. The inner side panel 108 extends vertically from the bottom fold line 83 to a top edge 104 and outwardly (horizontally) from the inner edge fold line 87 to a vertical fold line 112. A vertical slot 122 disposed in each inner side panel 108 adjacent the vertical fold line 112 accommodates a tab 52 extending from an angled panel 44 of the tray 12.

Each leg member 110 is foldably connected to an inner side panel 108 along a vertical fold line 112. Each leg member 110 extends from the bottom fold line 83 to the top edge 96 and from the vertical fold line 112 to a free edge 91. Preferably the free edge 91 forms a non-right angle with the inner edge fold line 87 so that the leg member 110 is wider near the top edge 96. Locator tabs 104 extend beyond the top edge 96.

Each foot member 92 extends outwardly from a leg member 110 and terminates at a free distal edge 98 substantially opposite the outer edge fold line 85. Each foot member 92 also has a free top edge 100 opposite and substantially parallel to the bottom fold line 83.

As with the outer half 82, each reinforcing panel 94 is substantially triangular and may be thought of as being located at the inner corner where the leg member 110 and the foot member 92 meet. Each reinforcing panel 94 has an angled free edge 102 that extends between the leg member free edge 91 and the foot member top edge 100. The angled free edge 102 of the reinforcing panel 94 defines a non-right angle with the top edge 100 of the foot member 92.

The inner half 84 further comprises flaps 114 cut out of the foot members 92. Each flap 114 is hingedly attached to the outer half foot member 92 along the bottom fold line 83 and has a perimeter defined by an inner angled edge 115, an outer angled edge 116 and a horizontal cutline 118. Each flap 114 defines a flap slot 120 adjacent the bottom fold line 83 and located to accommodate the tabs 54, 74 that extend downward from the inner panels 40, 60 of the tray side walls 22 and end walls 24 as explained further below.

The top edge 96 of the inner member 84—which appears at the bottom of FIG. 4—may include a notch 126 to accommodate a brace member 16. Cut outs 88 in the corner post blank 80 straddling the bottom edge fold line 83 just outside of the vertical fold lines 112 define notches 88 in the folded corner post 14. These notches 88 are vertically aligned with the locator tabs 104 so that they can receive the locator tabs 104 of a corner post 14 located on the tray 12 below.

Corner Post Assembly

Figure 5:
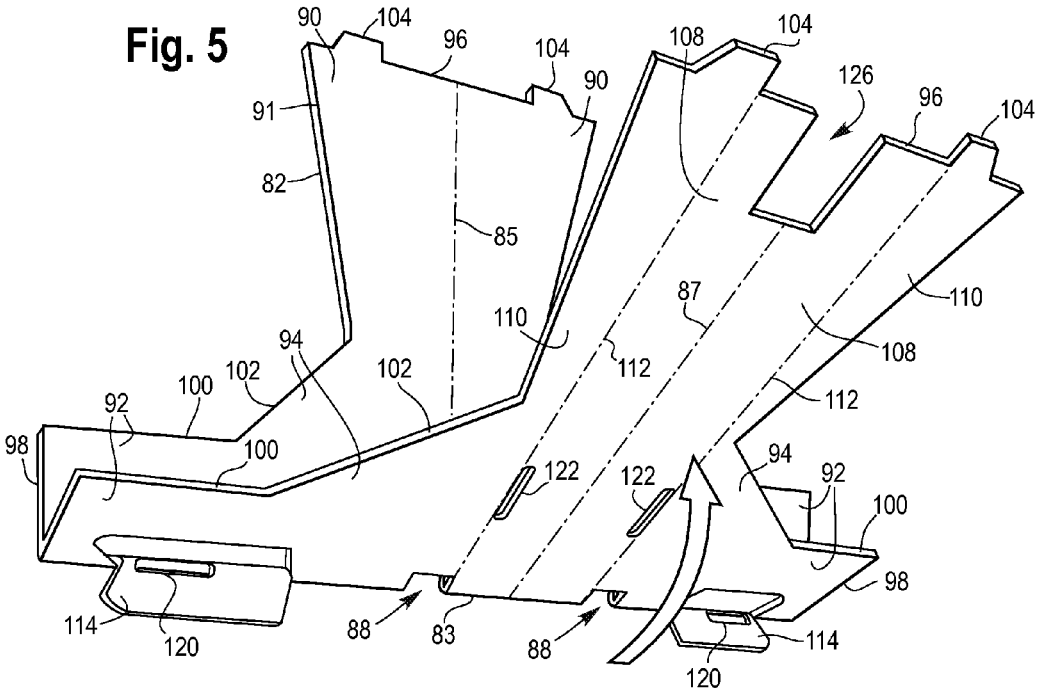
FIG. 5 is a perspective view of a partially assembled corner post.

To assemble a corner post 14 from the corner post blank 80 of FIG. 4, the corner post blank 80 may be folded along the bottom fold line 83 as shown in FIG. 5 until the inner half 84 lies flat against the outer half 82. The halves 82, 84 may be glued or otherwise affixed together. More specifically, the narrow leg members 110 and the foot members 92 of the inner half 84 may be adhered to the outer half 82, leaving the inner side panels 108 free to separate from the outer half 82 as explained below with regard to FIG. 7. The reinforcement panels 94 of the inner half 84 provide additional surface area that may be adhered to the outer half 82.

Figure 6:
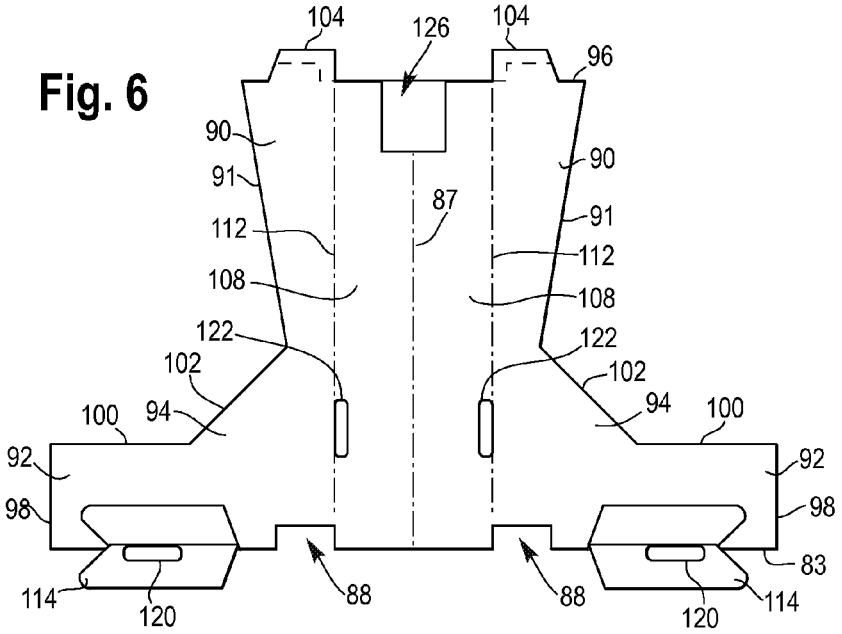
FIG. 6 is a top plan view of a partially assembled corner post.

The flaps 114 may be back-folded—away from the outer panel 90—until they are substantially orthogonal to the rest of the folded blank 80 or until they are planar with the rest of the folded blank 80 as shown in FIG. 6.

FIG. 6 is a perspective view of a corner post blank 80 after the inner half 84 and outer half 82 have been folded together and the flaps 114 back-folded so they are planar with the rest of the folded blank 80. A portion of each foot member 92 extends horizontally outward, beyond each flap 114.

Next, the partially assembled corner post 14 of FIG. 6 is folded along outer edge fold line 85 by bringing the two foot members 92 toward each other until they are orthogonal. As the two foot members 92 are brought toward each other, the two inner side panels 108 are popped out (folded inward) until each is orthogonal with its corresponding foot member 92 as shown in FIG. 7.

Figure 7:
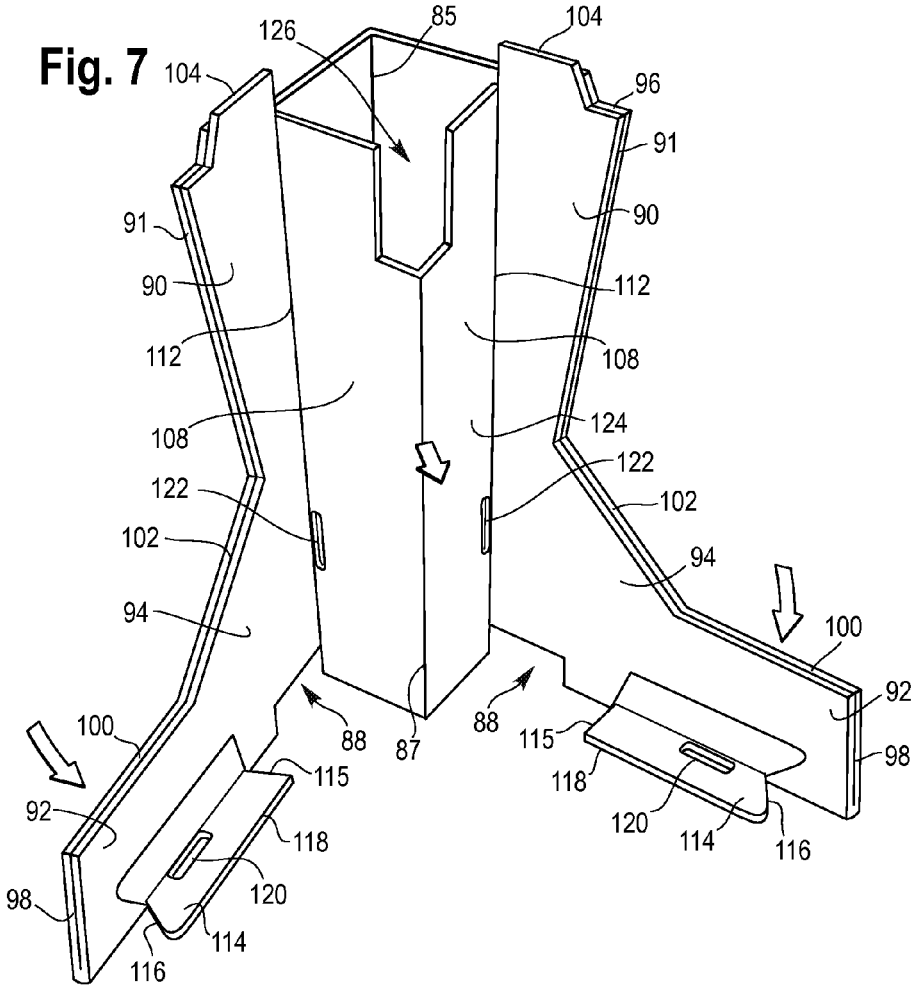
FIG. 7 is a close up perspective view of a fully assembled corner post.

The assembled corner post 14 shown in FIG. 7 includes foot members 92 and reinforcing panels 94 which extend outwardly from the leg members 90. The assembled corner post 14 includes a substantially rectilinear, tubular portion 124 having two outer sides and two inner sides 108. The two outer sides are formed by portions of the leg members 90 of the outer half 82 of the corner post blank 80 and are hingedly joined along the outer edge fold line or simply the "outer corner" 85. The two inner sides are formed by the inner side panels 108 of the inner half 84 of the corner post blank 80 and are hingedly joined along inner edge fold line or simply the "inner corner" 87. The tubular portion 124 includes a notch 126 for accommodating a brace member 16 for supporting the underside of a tray 12 located above the corner post 14. The notch 126 straddles the inner corner 87 of the corner post 14 and communicates with the top edge 96. The width of the notch 126 should be sized to securely hold a brace member 16.

The corner post 14 has a top edge 96 that abuts a tray 12 or top cap 15 resting on top and a bottom edge 83 that rests on a tray 12 below in the assembled packaging system 10.

Packaging System Assembly

Figure 8:
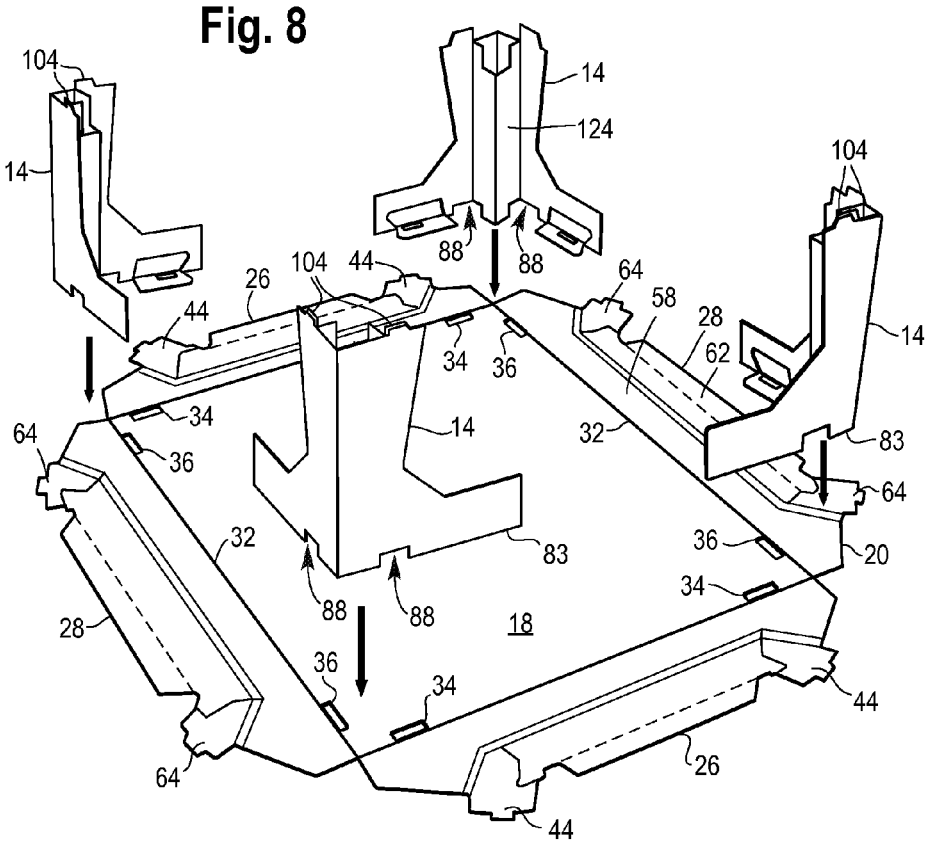
FIG. 8 is a perspective view of four corner posts being placed onto a tray blank.
Figure 9:
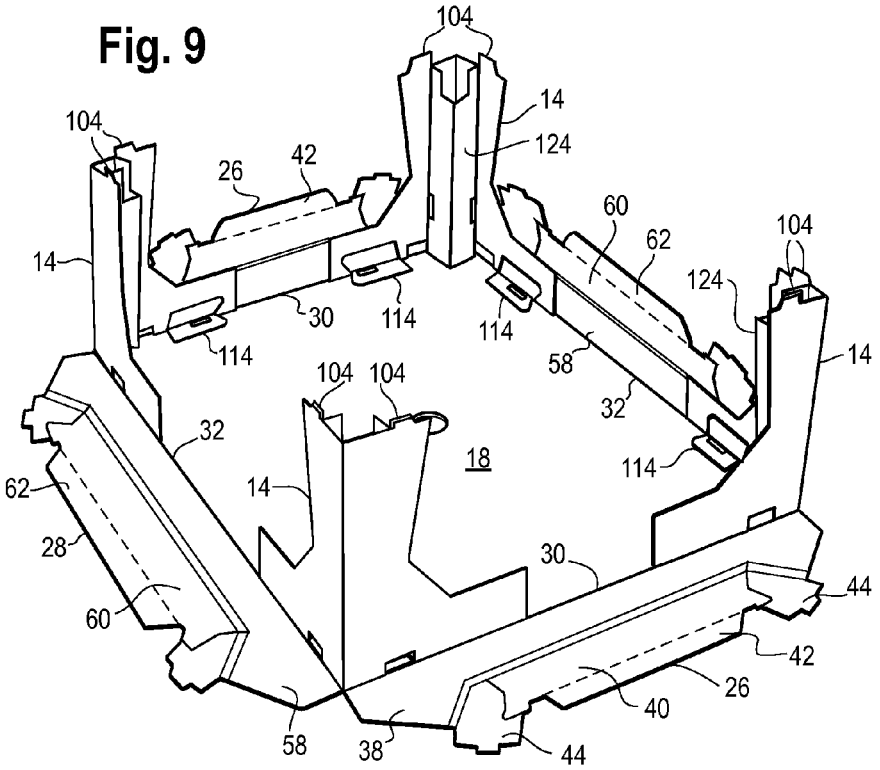
FIG. 9 is a perspective view of four corner posts positioned on a tray blank.

Each level of the packaging system 10 of FIG. 1 may be fabricated as follows. After assembling four corner posts 14 as described above, the corner posts 14 are placed onto the four corners of a flat tray blank 20 as shown in FIG. 8 with the bottom edge 83 of each corner post 14 resting on the bottom panel 18 and the corner post foot members 92 aligned just inside the perimeter edges 30, 32 of the bottom panel 18. The corner post locator tabs 104 will be pointing up and the foot members 92 will be extending outwardly from the tubular portion 124 of the corner post 14 as shown in FIG. 9.

Figure 10:
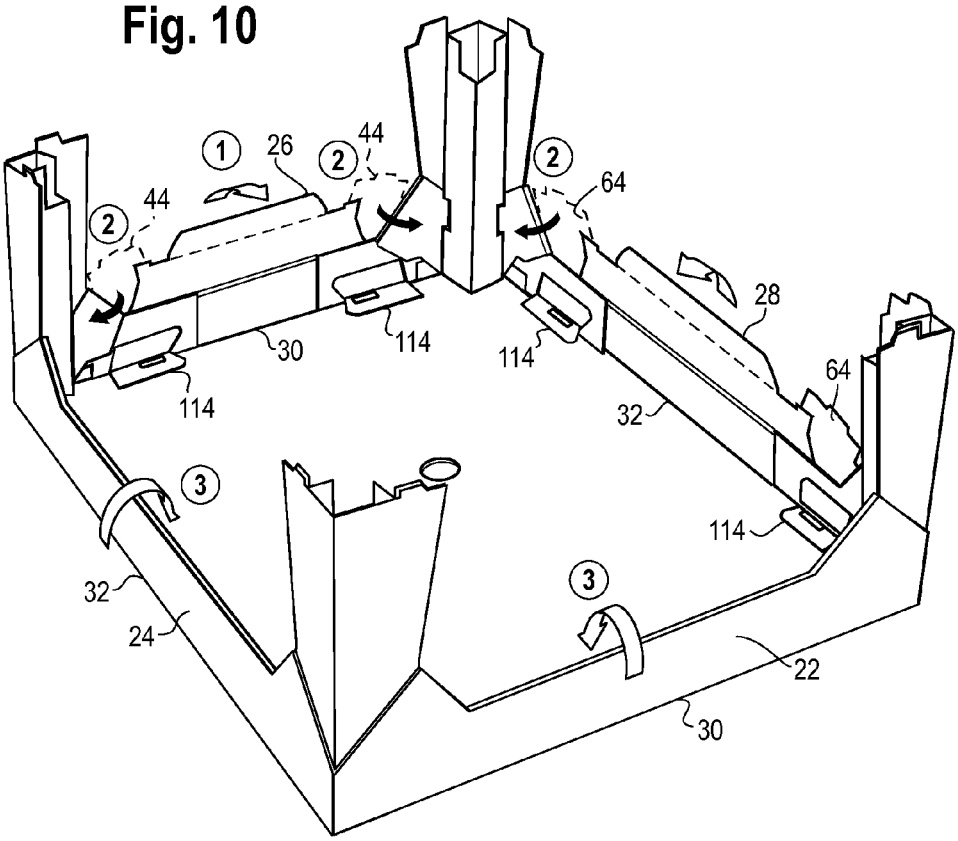
FIG. 10 is a perspective view of four corner posts being secured to a tray by the tray side walls and end walls.

Next the corner posts 14 are locked onto the tray 12, preferably using a three step process:

First, the side wall assemblies 26 and the end wall assemblies 28 are rotated along fold lines 30, 32 until they are in a vertical upright position, i.e., until they are substantially perpendicular to the bottom panel 18. In FIG. 10 the far side wall assembly 26 and the far end wall assembly 28 are shown in the vertical, upright position. (The near side wall 22 and near end wall 24 have already been formed according to step 3 below.)

Second, the eight angled panels 44, 64 are folded over along double angled fold lines 50 as shown by the arrows (2) in FIG. 10 until they overlap the corner posts 14 and, in particular, the reinforcing panels 94 of the corner posts 14. As the angled panels 44 are folded over, their tabs 52 fit into the vertical slots 122 located in the corner post 14. Likewise, the end wall angled panels 64 are folded independently along double angled fold lines 70 until they overlap the corner posts 14 and, in particular, the reinforcing panels 94 of the corner posts 14. As the angled panels 64 are folded over, their tabs 72 fit into the vertical slots 122 located in the corner post 14.

Figure 11:
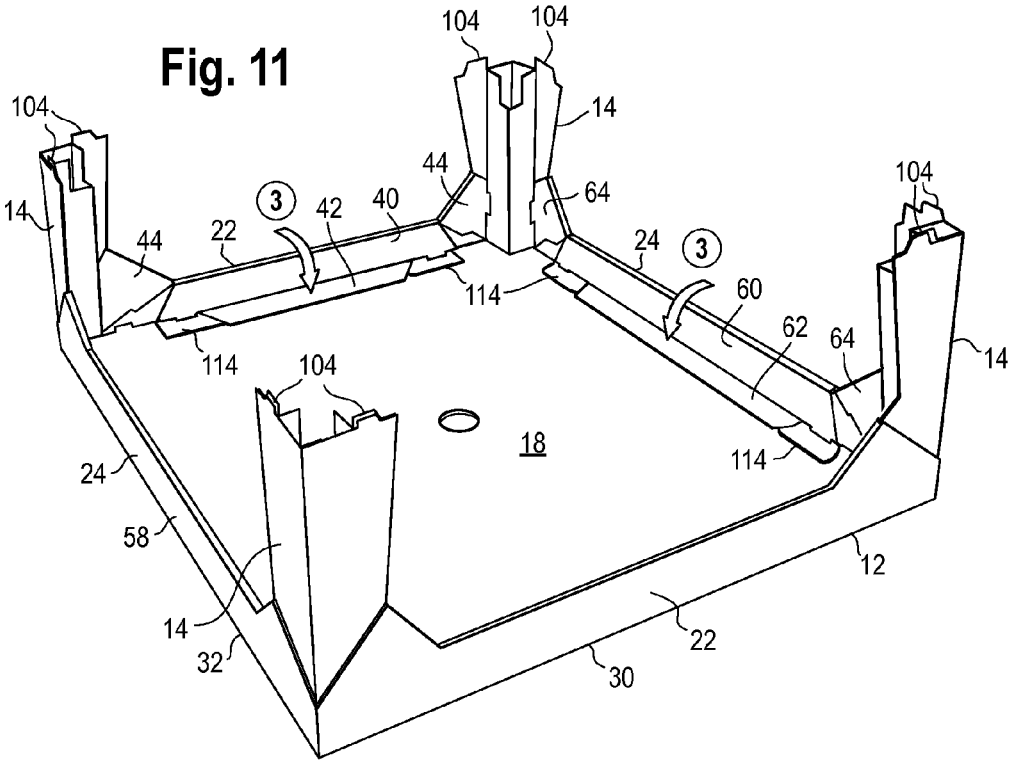
FIG. 11 is a perspective view of four corner posts being further secured to a tray by the tray side walls and end walls.

Third, the tray side walls 22 and end walls 24 are formed by folding the side wall and end wall assemblies 26, 28 as shown by the arrows (3) in FIGS. 10 and 11. In FIG. 10 one side wall 22 and one end wall 24 have been formed, while in FIG. 11 both side walls 22 and both end walls 24 are formed. The side walls 22 are formed by first folding each side wall assembly 26 inwardly along the first side fold line 30 until they are substantially perpendicular to the bottom panel 18. The lip 42 is back-folded (away from the bottom panel 18) along the third side fold line 48 until the lip 42 is at a right angle to the inner panel 40. The inner panels 40 are folded inwardly along the double side fold lines 46 until the inner panels 40 are in facing, abutting relationship with the outer panels 38 and the lips 42 are in facing, abutting relationship with the tray bottom panel 18 and the tabs 54 are inserted into the flap slots 120 in the corner post flaps 114.

The end walls 24 are assembled in a similar manner by first folding each end wall assembly 28 inwardly along the first end fold line 32 until they are substantially perpendicular to the bottom panel 18. Then the end panel lips 62 are folded backward (away from the bottom panel 18) along the third end fold lines 68 until they are horizontal (at right angles to the end wall outer panels 58). The inner panels 60 are folded inwardly along the double end fold lines 66 until the inner panels 60 are in facing, abutting relationship with the outer panels 58 and the end wall lips 62 are in facing, abutting relationship with the tray bottom panel 18 and the tabs 74 are inserted into the flap slots 120 in the corner post flaps 114. The side wall lips 42 and end wall lips 62 may be glued or otherwise affixed to the tray bottom panel 18.

Figure 12:
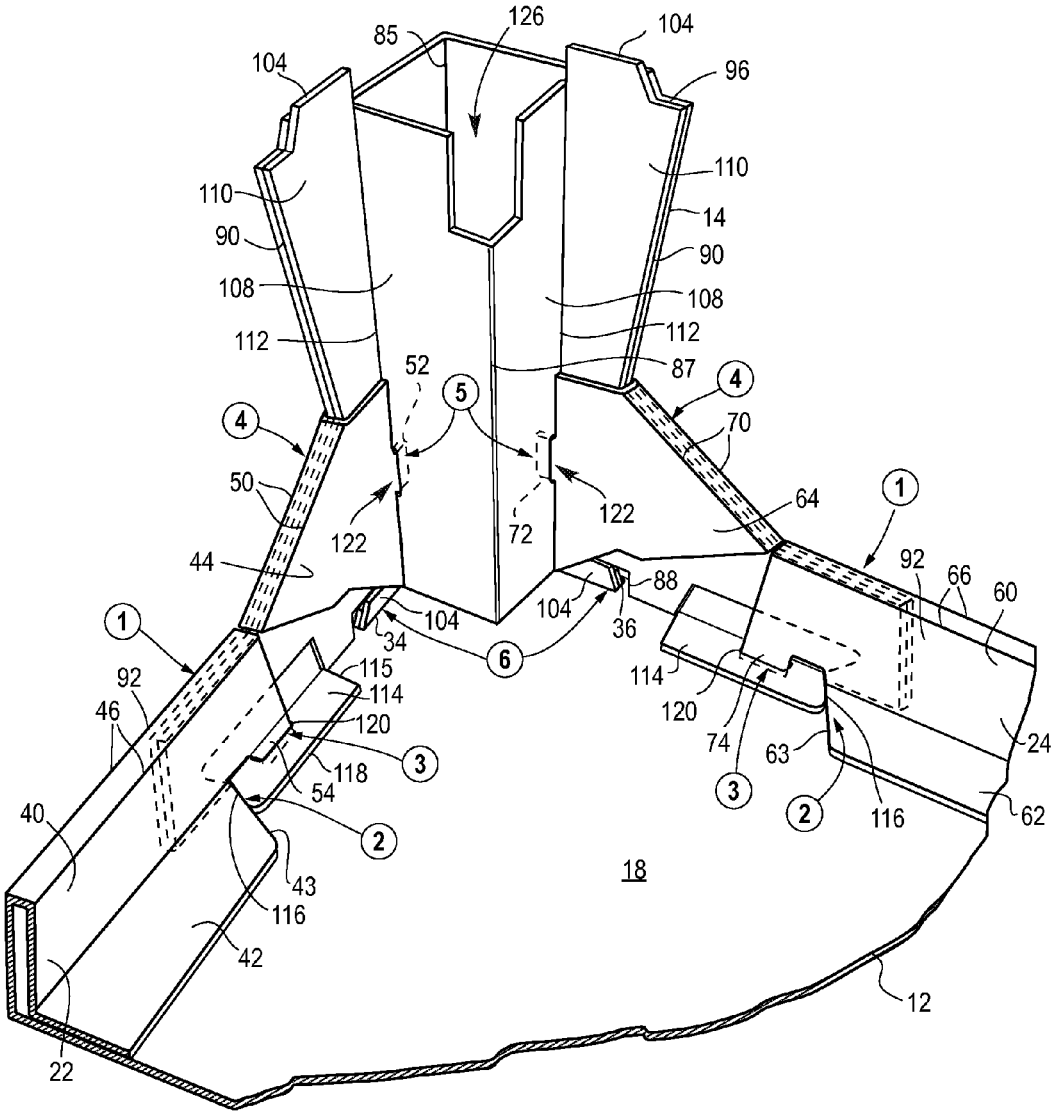
FIG. 12 is a close up perspective view of a corner post shown fully secured to a tray.

FIG. 12 is a close up perspective view of a corner post 14 shown attached to a tray 12. The corner post foot members 92 are now captured (partially encapsulated) by the tray side walls 22 and end walls 24. The tray lips 42, 62 function as a stopper by abutting the outer edges 116 of the corner post flaps 114. The lips 42, 62 may be angled to mate with the outer edges of the corner post flaps 114. When the user folds in each side wall assembly 26 and end wall assembly 28 as described above, the inner edges 43, 63 of each lip 42, 62 may contact and wedge against the outer edges 116 of the flaps 114 of the corner post 14. The flaps 114 help keep the side wall and end wall lips 42, 62 in their horizontal position by contacting the inner edges 43, 63 of the lips 42, 62.

When a second tray and corner post assembly is placed on top of the first assembly, the upwardly extending locator tabs 104 will fit through corresponding slots 34, 36 located in the second (upper) tray 12 and into the bottom notches 88 of the corner post 14 above to help hold the two trays 12 in vertical alignment. Additional tray and post layers may be placed on top until the assembled unit has the desired numbers of layers. A top cap 15 may be placed over the top level of corner posts 14 so that its side walls and end walls extend downward to help secure the top cap 15 to the upwardly extending corner posts 14 by fitting the corner posts snugly within the top cap side walls and end walls. The locator tabs 104 of the topmost corner posts 14 may extend through corner slots in the top cap 15 as shown in FIG. 1. Finally, the entire assembly 10 may be wrapped in transparent plastic film to protect the products from dust and damage during shipment.

Referring to FIG. 12, the corner posts 14 and trays 14 may be locked together in a number ways:

(1) The tray side walls 22 and end walls 24 capture (partially enclose) the corner post foot members 92.

(2) The tray lips 42, 64 abut the outer edges 116 of the corner post flaps 114.

(3) Tabs 54, 74 extend downward from the tray side walls 22 and end walls 24 and fit into flap slots 120 in the corner post flaps 114.

(4) The tray angled panels 44, 64 capture (partially enclose) the corner post reinforcing panels 94.

(5) Tabs 52, 72 extending from the angled panels 44, 64 of the tray 14 fit into vertical slots 122 in the corner posts 14.

(6) Locator tabs 104 extending upward from the corner posts 14 located below the tray 12 fit through slots 34, 36 in each tray 12 and into notches 88 in each corner post.

Braces

While the packaging system 10 just described is suitable for many applications, in other applications it is desirable to reinforce the trays 12 with horizontal braces 16 as shown in FIG. 2 herein and as disclosed in co-owned U.S. patent application Ser. No. 13/350,913, incorporated herein by reference.

Thus there has been described a packaging system for shipping and displaying products. The system enhances product visibility and reduces packaging waste and material costs by eliminating the need for partitions or dividers. The system is strong enough not only to support the weight of the products on the trays and withstand the vibration and impact forces that can occur during shipping, but also to withstand the weight of one or more units stacked on top. The system is particularly suited for shipping and displaying irregularly shaped items or items that cannot withstand vertical stacking forces, such as soft-packaged products, since the system can bear the entire stacking load.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A unitary folded blank for making a corner post, the folded blank comprising:

an outer half and an inner half foldably connected to each other along a bottom fold line;

the outer half comprising two substantially L-shaped outer panels foldably connected along an outer edge fold line, each L-shaped outer panel comprising an outer leg member adjacent the outer edge fold line and an outer foot member extending outwardly from the outer leg member away from the outer edge fold line and terminating at a free distal edge, and an outer reinforcing panel having an outer angled free edge extending between the outer leg member and the outer foot member, the outer leg member, outer foot member and outer reinforcing panel forming one contiguous, unitary structure lacking any fold or score lines; and the inner half comprising two substantially L-shaped inner panels foldably connected along an inner edge fold line, the inner edge fold line being co-linear with the outer edge fold line, each L-shaped inner panel comprising an inner side panel adjacent the inner edge fold line, a narrow leg member hingedly attached to the inner side panel along a vertical fold line, an inner foot member extending outwardly from the narrow leg member and terminating at a free distal edge, and an inner reinforcing panel having an inner angled free edge extending between the narrow leg member and the inner foot member, the narrow leg member, inner reinforcing panel and inner foot member forming one contiguous substantially L-shaped structure lacking any fold or score lines.

2. The unitary folded blank of claim 1 wherein:

the inner half further comprises a flap cut out of each inner foot member and hingedly attached to the outer foot member along the bottom fold line.

3. The unitary folded blank of claim 1 wherein the inner half further comprises:

a top edge opposite and parallel to the bottom fold line;

locator tabs extending from the top edge; and cut outs adjacent the bottom fold line, the cut outs being vertically aligned with the locator tabs.

4. A corner post made from a folded blank having an outer half and an inner half connected by a bottom fold, the corner post comprising:

a four-sided, substantially rectilinear tubular portion comprising two inner side panels formed from the inner half and hingedly connected along an inner edge fold line and two outer leg members formed from the outer half and hingedly connected along an outer edge fold line;

a top edge opposite and parallel to the bottom fold line;

locator tabs extending from the top edge;

cut outs adjacent the bottom fold line, the cut outs being vertically aligned with the locator tabs; and a foot member extending laterally outward from each leg member.

5. The corner post of claim 4 further comprising:

a reinforcing panel having an angled free edge extending between the leg member and the foot member.

6. The corner post of claim 4 further comprising:

a flap cut out of each inner half and hingedly attached to the foot member along the bottom fold line.

7. The corner post of claim 4 wherein:

the inner half further comprises a narrow leg member hingedly attached to each inner side panel along a vertical fold line.

8. A packaging system for shipping and displaying products, the packaging system comprising:

a tray made from a first folded blank and having a bottom panel for supporting the products and having a perimeter, and two opposing side walls and two opposing end walls extending upward from the perimeter; and a corner post made from a second folded blank having an outer half and an inner half foldably connected along a bottom fold line, the corner post comprising a four-sided, substantially rectilinear tubular portion comprising two inner side panels formed from the inner half and hingedly connected along an inner edge fold line and two leg members formed from the outer half and hingedly connected along an outer edge fold line, and a foot member extending laterally outward from each leg member and forming a corner therewith; wherein one foot member is at least partially encapsulated within a side wall and the other foot member is at least partially encapsulated within an end wall.

9. The packaging system of claim 8 wherein:

the corner post further comprises a reinforcing panel disposed at the corner, the reinforcing panel having an angled free edge extending between a leg member and a foot member.

10. The packaging system of claim 9 wherein:

at least one of the side walls comprises an outer panel foldably connected to the bottom panel along a side fold line co-linear with the perimeter, an inner panel foldably connected to the outer panel along double fold lines parallel to the side fold line, a lip foldably connected to the inner panel along a lip fold line parallel to the side fold line, and an angled panel foldably connected to the outer panel along angled double fold lines, the angled double fold lines forming a non-right angle with the double fold lines; wherein the angled panel at least partially encapsulates the reinforcing panel.

11. The packaging system of claim 10 wherein:

at least one of the inner side panels defines a vertical slot; and the angled panel has a tab extending into the vertical slot.

12. The packaging system of claim 10 wherein:

the inner half further comprises a flap hingedly attached to the foot member along the bottom fold line, the flap defining a flap slot adjacent the bottom fold line; and wherein a tab extending downward from the inner panel extends into the flap slot.

13. The packaging system of claim 10 wherein:

the inner half further comprises a flap hingedly attached to the foot member along the bottom fold line; and wherein the lip abuts the flap.

* * * * *